US005816419A

United States Patent [19]

Lamson

[11] Patent Number: 5,816,419

[45] Date of Patent: Oct. 6, 1998

[54] MOVEABLE, NESTABLE DISPLAY RACKS AND STOCK CARTS

[75] Inventor: Frederick W. Lamson, Birmingham, Mich.

[73] Assignee: Lockwood Manufacturing Company, Livonia, Mich.

[21] Appl. No.: 818,335

[22] Filed: Mar. 14, 1997

[51] Int. Cl.[6] ..... A47F 5/00

[52] U.S. Cl. ..... 211/150; 211/59.2; 248/242; 280/79.3

[58] Field of Search ..... 211/150, 59.2, 211/170, 99; 248/242; 280/47.19, 79.3

[56] References Cited

U.S. PATENT DOCUMENTS

| | | | |
|---|---|---|---|
| 318,991 | 6/1885 | Kelly . | |
| 638,443 | 12/1899 | Canedy . | |
| 1,039,694 | 10/1912 | Burton . | |
| 1,577,583 | 3/1926 | McCartney . | |
| 1,647,723 | 11/1927 | Casali . | |
| 2,039,758 | 5/1936 | Wayne | 211/99 |
| 2,070,174 | 2/1937 | Pace | 211/99 X |
| 2,637,445 | 5/1953 | Patterson . | |
| 2,716,495 | 8/1955 | Prevette et al. . | |
| 3,045,831 | 7/1962 | Pendergrast, Jr. et al. . | |
| 3,074,734 | 1/1963 | Mudson et al. . | |
| 3,151,576 | 10/1964 | Patterson . | |
| 3,335,874 | 8/1967 | Levy et al. . | |
| 3,426,993 | 2/1969 | Johansson | 248/242 |
| 3,527,360 | 9/1970 | Thialking . | |
| 3,700,114 | 10/1972 | Myers | 248/242 X |
| 3,795,379 | 3/1974 | Gray | 248/242 |
| 3,827,376 | 8/1974 | Solomon . | |
| 3,841,237 | 10/1974 | Plymate . | |
| 3,915,097 | 10/1975 | Young, Jr. . | |
| 3,921,539 | 11/1975 | Berger . | |
| 4,200,195 | 4/1980 | Hager . | |
| 4,478,428 | 10/1984 | Ziliani . | |
| 4,531,646 | 7/1985 | Howard . | |
| 4,627,542 | 12/1986 | Fredrickson . | |

FOREIGN PATENT DOCUMENTS

| | | | |
|---|---|---|---|
| 0492409 | 9/1976 | Australia | 248/242 |

*Primary Examiner*—Robert W. Gibson, Jr.
*Attorney, Agent, or Firm*—Young & Basile, P.C.

[57] ABSTRACT

A display rack or stock cart including a base structure, a pair of spaced posts upstanding from the base structure, and a plurality of shelves supported on the posts in vertically spaced relation. A series of pins are provided on the posts for selective coaction with a series of notches on the shelves to allow each shelf to be mounted on the posts in a first generally horizontal position, or a second downwardly inclined position, or a third generally vertically downwardly extending nesting position. The shelves are moveable between their various positions by simple pivoting and sliding movement of the shelves relative to the posts and the shelves in their downwardly extending position allow nesting the plurality of display racks.

14 Claims, 3 Drawing Sheets

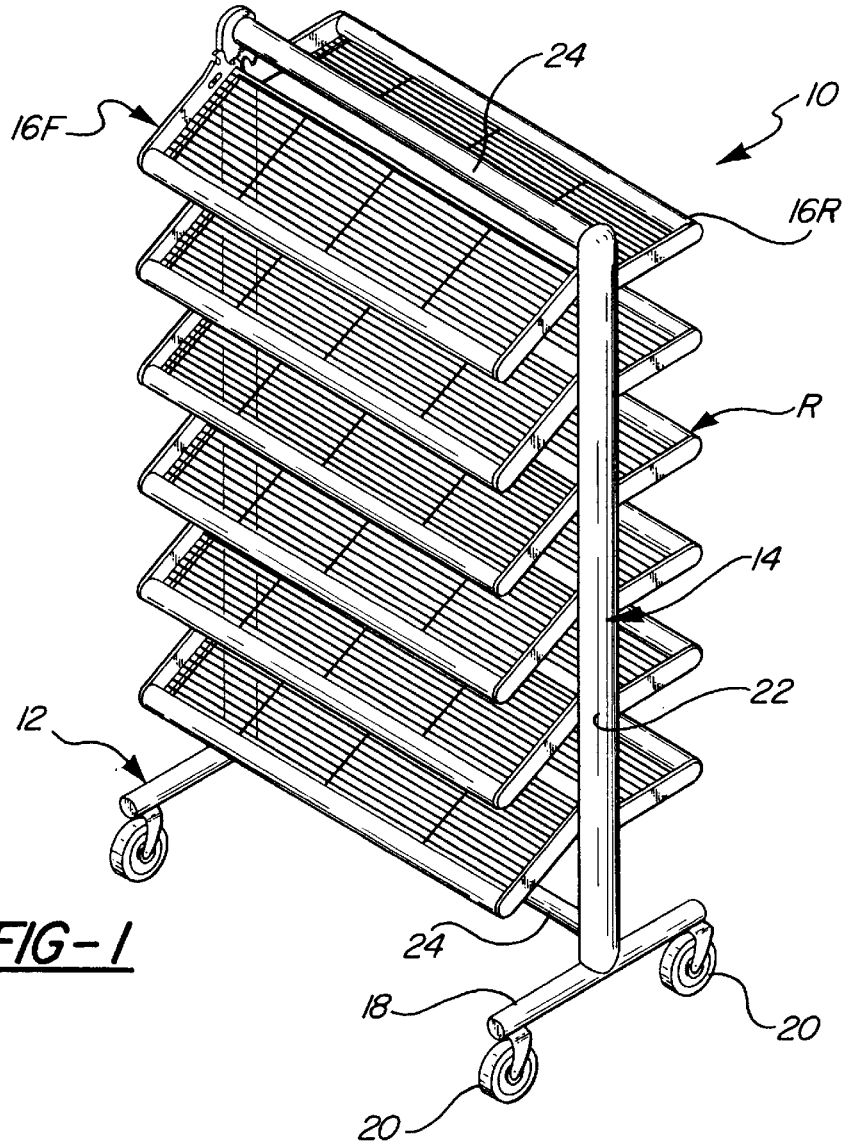
FIG-1
FIG-2
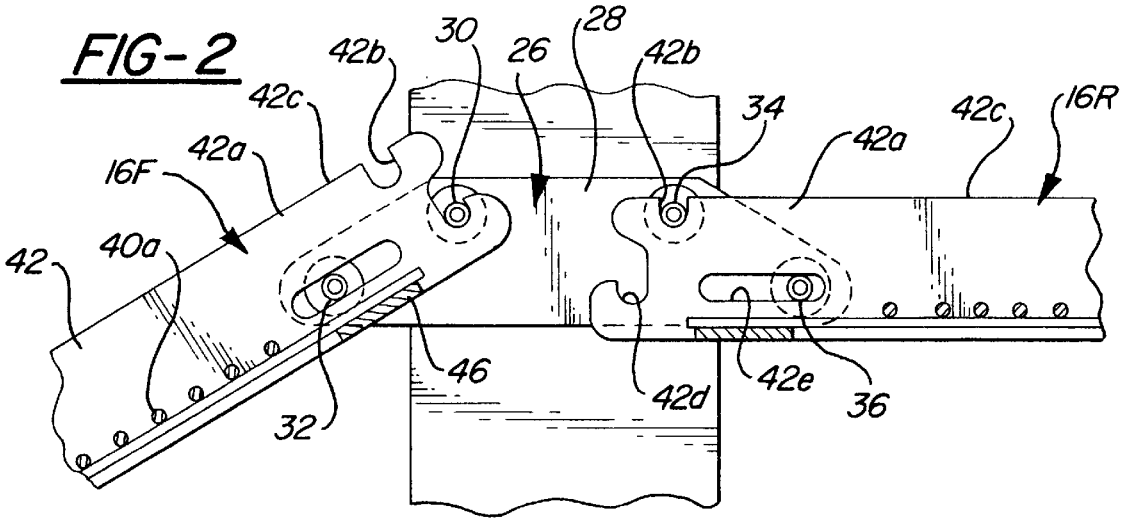

MOVEABLE, NESTABLE DISPLAY RACKS AND STOCK CARTS

BACKGROUND OF THE INVENTION

This invention relates to display racks or stock carts and more particularly to display racks or stock carts that are especially suitable for use in merchandizing environments.

It is desirable in a merchandizing environment to provide a display surface area that is readily adjustable to suit varying display needs, that is readily moveable to various display locations within the merchandizing environment, and that is readily nestable to minimize storage space when not in use. Whereas a plurality of racks or carts have been proposed and/or utilized in an attempt to satisfy these merchandizing requirements, these racks have either been complicated and expensive and/or have been difficult to adjust to suit varying merchandizing needs and/or have been difficult to nest when not in use.

SUMMARY OF THE INVENTION

This invention is directed to the provision of an improved merchandizing display rack.

More particularly, this invention is directed to the provision of a merchandizing display rack that is simple and inexpensive in construction, that is readily adjustable to suit varying merchandizing requirements, and that is readily nestable when not in use.

The invention display rack/stock cart is of the type including a base structure, an upright member extending rigidly upwardly from the base structure, and at least one shelf member supported on the upright member.

According to the invention, coacting interengaging means are provided on the shelf member and on the upright member operative to selectively mount the shelf on the upright member in a first defined generally horizontal position in which the shelf member is precluded from downward movement, a second defined downwardly inclined position in which the shelf member is precluded from further downward movement, and a third generally vertically downwardly extending position. This arrangement allows the shelf to be moved readily between various display positions and to be further moved readily to a downwardly extending position to facilitate nesting.

According to a further feature of the invention, the coacting interengaging means comprises coacting notches on one of the members and pins on the other of the members. In the disclosed embodiment of the invention, the pins are provided on the upright member and the notches are provided on the shelf member. This pin and notch arrangement provides a simple and efficient means for defining the various mounting positions of the shelf member on the upright member.

According to a further feature of the invention, the pins comprise a first pin on the other member and a second pin on the other member in laterally and vertically spaced relation to the first pin; the notches comprise a first notch on the one member and a second notch on the one member; with the shelf member in its horizontal position the first pin is positioned in the first notch; and with the shelf member in its downwardly inclined position, the first pin is positioned in the second notch. This specific notch and pin coacting relationship effectively defines the shelf member display positions.

According to a further feature of the invention, the coacting means further includes a slot in the one member and the second pin is positioned slidably in the slot. The positioning of the second pin slidably in the slot facilitates the movement of the shelf between its display positions.

According to a further feature of the invention, with the shelf member in its vertically downwardly extending position, the second pin is positioned in an upper end of the slot and the first and second notches are disengaged from the pins. This specific arrangement allows the slot to define the downwardly extending position of the shelf member.

According to a further feature of the invention, the upright member comprises a first upright member and the slot comprises a first slot; the display rack further includes a second upright member in spaced relation to the first upright member and including third and fourth pins corresponding in placement and spacing to the first and second pins; the shelf member is positioned between the first and second upright members; the shelf member includes a main body portion and spaced first and second attachment portions; the first and second notches in the first slot are defined on the first attachment portion; the second attachment portion defines third and fourth notches corresponding in placement and spacing to the first and second notches and a second slot corresponding to the first slot; with the shelf member in its horizontal position, the first and third pins are positioned in the first and third notches respectively and the second and fourth pins are slidably positioned in the first and second slots respectively; and with the shelf member in its downwardly inclined position the first and third pins are positioned in the second and fourth notches respectively and the second and fourth pins are slidably positioned in the first and second slots respectively. This specific arrangement allows the shelf to be moved smoothly and effectively between its various mounted positions.

According to a further feature of the invention, with the shelf member in its vertically downwardly extending position, the second and fourth pins are positioned in an upper end of the first and second slots respectively and the first, second, third, and fourth notches are disengaged from the pins. This arrangement provides an effective means of defining the downwardly extending position.

According to a further feature of the invention, the display rack includes a plurality of shelf members arranged in vertically spaced relation between the upright members and each including notches and slots for coacting engagement with pins on the upright members, whereby each of the shelf members may be mounted on the upright member in horizontal, downwardly inclined, or vertically extending positions.

According to a further feature of the invention, the display rack includes casters mounted on the base structure to facilitate movement of the display rack around the display surface area.

According to a further feature of the invention, the plurality of vertically spaced shelf members comprise a first set of shelf members; the first set of shelf members extend forwardly from the upright member; the display rack further includes a second set of vertically spaced shelf members extending rearwardly from the upright member; and each shelf member of the second set includes notches and slots for coacting engagement with pins on the upright members, whereby each of the shelf members of the second set may be mounted on the upright member in horizontal, downwardly inclined, and vertically and downwardly extending positions.

According to a further feature of the invention, the base structure includes spaced base members defining an opening therebetween. This arrangement allows the base structure of a second display rack to be moved into the opening to allow nesting of the display racks with the shelf member of each display rack in its downwardly extending position.

BRIEF DESCRIPTION OF THE DRAWINGS

FIG. 1 is a perspective view of a display/stock cart according to the invention;

FIG. 2 is a detail, fragmentary view showing the adjustable mounting of the shelf members of the display/stock cart on a frame structure of the cart;

DETAILED DESCRIPTION OF THE PREFERRED EMBODIMENT

Figure 3:
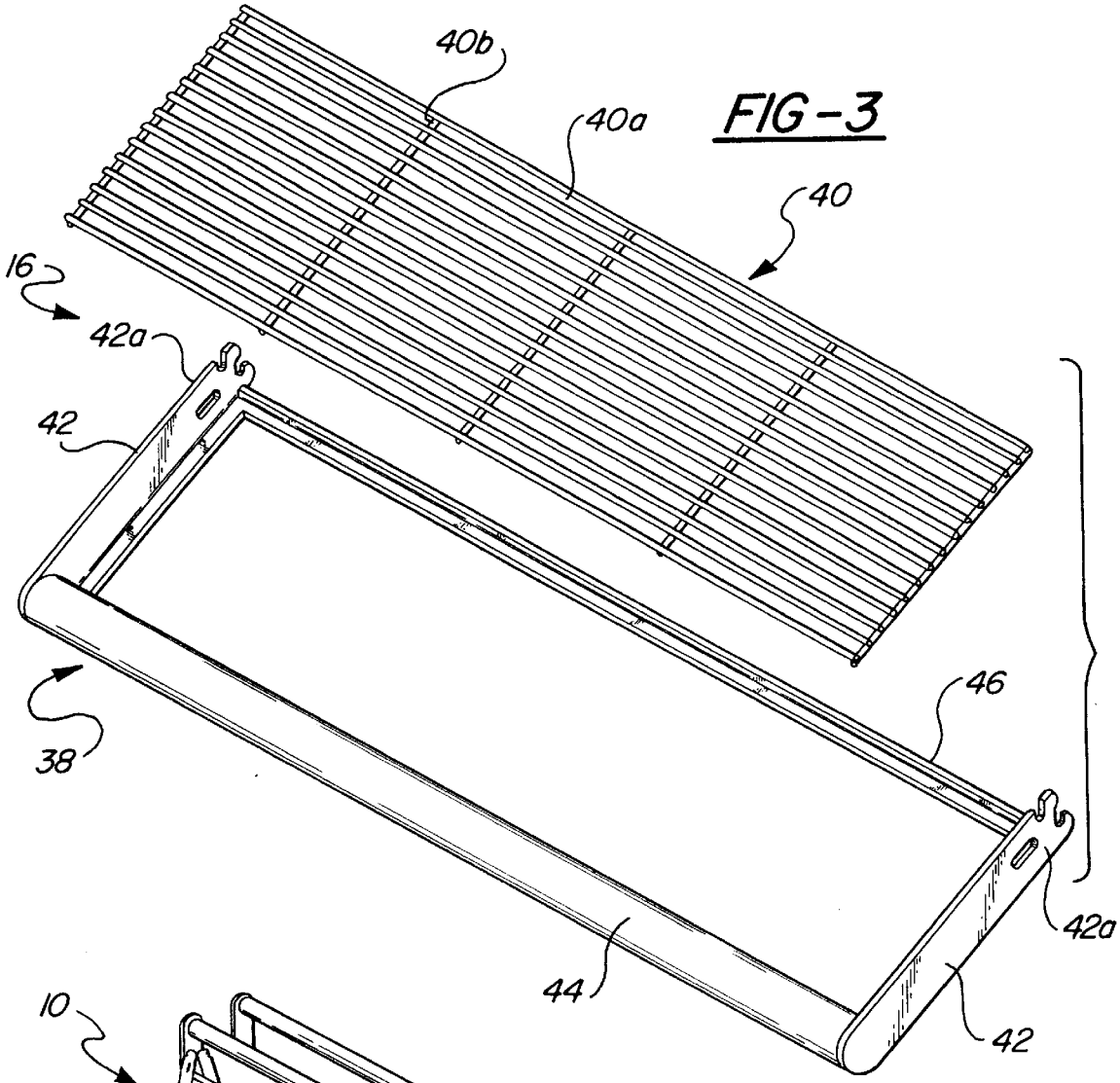
FIG. 3 is an exploded perspective view of a shelf utilized in the invention display/stock cart.

The display/stock cart 10 of the invention, broadly considered, includes (FIG. 1) a base structure 12, an upright frame structure 14, and shelves 16.

Base structure 12 includes a pair of laterally spaced parallel horizontal rods 18 and casters 20 mounted on the forward and rearward end of each rod.

Figure 5:
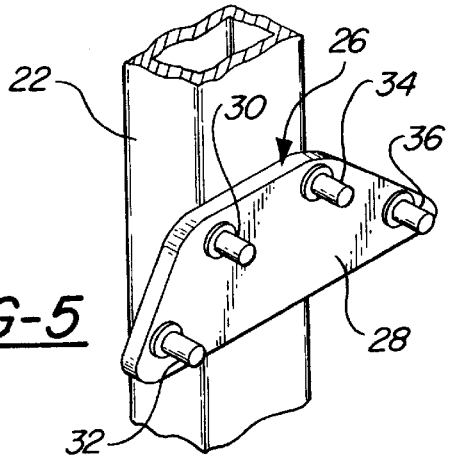
FIG. 5 is a detail view of a mounting bracket utilized in the invention display/stock cart.
Figure 6:
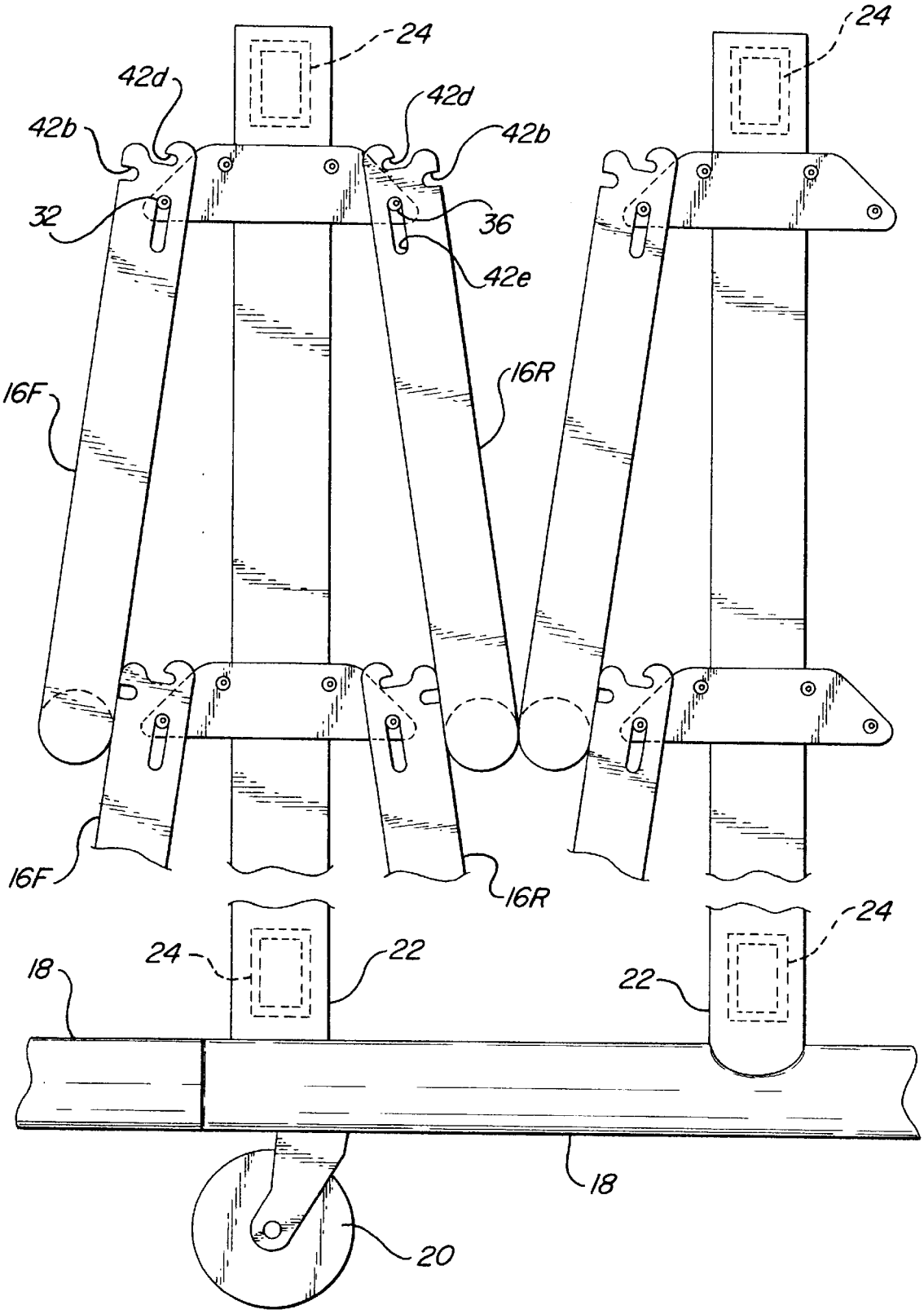
FIG. 6 is a fragmentary view showing the mounting and nesting of the shelf members.

Upright frame structure 14 includes a pair of laterally spaced posts 22, a plurality of cross bars 24 interconnecting the posts at vertically spaced locations, and a plurality of mounting brackets 26 (FIGS. 2, 5 and 6).

Brackets 26 are weldingly secured to inboard surfaces of posts 22 in paired relation with a plurality of vertically spaced brackets positioned on the inboard face of one post 22 and a corresponding plurality of vertically spaced brackets positioned on the inboard space of the other post in confronting relation to the brackets secured to the inboard face of the first post.

Each bracket 26 includes a plate structure 28 having a truncated pyramidal configuration and pins 30, 32, 34, and 36 positioned proximate the four corners of the plate structure. Pins 30–36 may, for example, comprise weld nuts weldingly secured through the inboard face of the plate structure 28. Each shelf 16 (FIGS. 2 and 3) includes an open frame structure 38 and a tray 40.

Open frame structure 38 includes laterally spaced arms 42, an outer cross rail 44, and an inner cross rail 46.

Tray 40 has a grate structure including longitudinal rods 40*a* and transverse rods 40*b* and is sized to fit within the open frame structure 38 to define the shelf.

Each arm 42 defines an attachment portion 42*a* at the inboard end of the arm proximate inner cross member 46. Each attachment portion 42*a* defines a first notch 42*b* in an upper edge 42*c* of the arm proximate the inboard end of the arm, a second notch 42*d* in the inboard end edge of the arm, and a slot 42*e* extending longitudinally of the arm from a location proximate the inboard end of the arm toward the outboard end.

As best seen in FIG. 1, the shelves are arranged as a first plurality or set of shelves 16F extending generally forwardly from the posts 22 and a second plurality or set of shelves 16R extending generally rearwardly from the posts 22 with a forward shelf 16F and a rearward shelf 16R associated with each bracket pair 26. Each shelf 16F or 16R may be positively mounted on the posts 22 in either a defined generally horizontal position (illustrated by shelf 16R in FIG. 2); a defined downwardly inclined position (illustrated by shelf 16F in FIG. 2); or a generally vertically downwardly extending storage or nesting position (illustrated by shelves 16F and 16R of FIG. 6.)

In the horizontal position of a rear shelf 16R, each pin 34 is received in a notch 42*b* and each pin 36 is slidably received in a slot 42*e*. The pins, notches, and slots will be seen to coact to define the horizontal position of the shelf and to preclude downward movement of the shelf from the horizontal position.

In the horizontal position of a forward shelf 16F, each pin 30 is received in a notch 42*b* and each pin 32 is slidably received in a slot 42*e*. The pins, notches, and slots will again be seen to coact to define the horizontal position of the shelf and to preclude downward movement of the shelf from the horizontal position.

In the downwardly inclined position of a rear shelf 16R, each pin 34 is received in a notch 42*d* and each pin 36 continues to be slidably received in a slot 42*e*. The pins, notches, and slots will be seen to define the downwardly inclined position of the shelf and to preclude further downward movement of the shelf from the downwardly inclined position.

In the downwardly inclined position of a forward shelf 16F, each pin 30 is received in a notch 42*d* and each pin 32 continues to be slidably received in a slot 42*e*. The pins, notches, and slots will again be seen to define the downwardly inclined position of the shelf and to preclude further downward movement of the shelf out of the downwardly inclined position.

In the generally vertically downwardly extending position of a rear shelf 16R, each pin 36 is positioned in the upper end of a slot 42*e* and notches 42*b* and 42*d* are disengaged from the pins so that the shelf may hang freely downwardly from pins 36.

In the generally vertically downwardly extending position of a front shelf 16F, each pin 32 is received in the upper end of a slot 42*e* and notches 42*b* and 42*d* are disengaged from the pins so that the shelf may hang freely downwardly from pins 32.

A shelf is moved from the horizontal position to the intermediate downwardly inclined position by pivoting the shelf upwardly about the pin 32, 36 received in the slot 42*e* to clear notch 42*b* from pin 30, 34 and then pulling the shelf forwardly or rearwardly (as allowed by sliding movement of the pin 32, 36 in slot 42*e*) until the inboard end of the shelf clears pin 30, 34 whereafter the shelf may be pivoted downwardly to move pin 30, 34 into notch 42*d* with the requisite forward or rearward movement of the shelf again being allowed by sliding movement of pin 32, 36 in slot 42*e*.

To move a shelf from the intermediate downwardly inclined position to the downwardly extending position, the shelf is again pivoted upwardly about the axis of pin 32, 36 until pin 30, 34 is cleared from notch 42*d* whereafter the shelf is slid forwardly or rearwardly as allowed by sliding movement of pin 32, 36 in slot 42*e* to clear the inboard end of the arm from the pin 30, 34 whereafter the shelf may be pivoted downwardly to move the pin 32, 36 into the upper end of slot 42*e* where it serves to support the shelf in downwardly hanging relation.

As will be apparent, the shelves may also be moved directly between the horizontal position and the downwardly extending position by appropriate pivotal and sliding movement.

Figure 4:
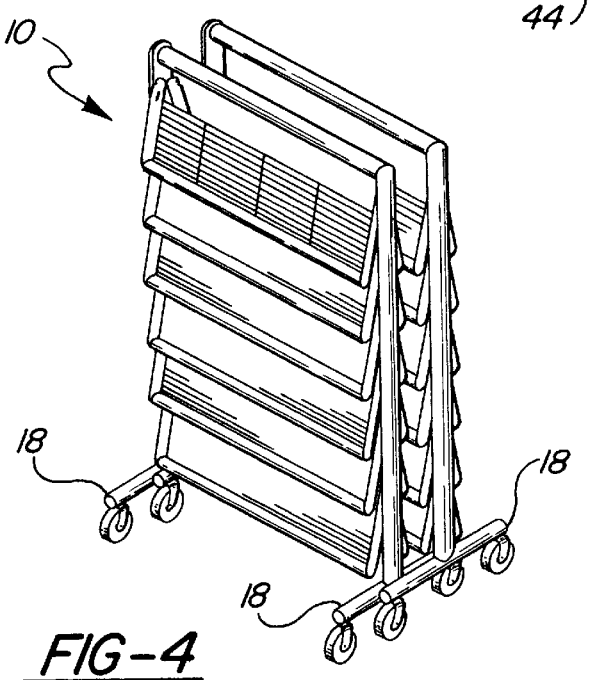
FIG. 4 is a perspective view showing the manner in which display/stock carts of the invention nest with each other.

The size and spacing of the shelves may be selected so that each shelf, in its downwardly extending position, may hang in a true vertical plumb line relation from the respective pin 32, 36. However, as seen in FIGS. 4 and 6, each shelf may be wider than the spacing between vertically spaced bracket pairs 26 so that the lower end of each hanging shelf overlies and rests against the upper end of a lower downwardly extending shelf.

With all of the shelves in the hanging or downwardly extending position, a plurality of display racks/stock carts may be moved into a nesting relation (FIGS. 4 and 6) wherein the horizontal base rods 18 of one display rack/stock cart are laterally staggered with respect to the horizontal base rods 18 of the adjacent display rack so as to allow the base structure of one display rack/stock cart to move into the opening defined between the spaced horizontal base rods of a second display rack/stock cart and thereby allow the racks/carts to achieve a nested relation. In this regard, note that the lowest cross rod 24 of the upright frame structure is high enough to allow horizontal base rods 18 to move therebeneath during the nesting operation.

Although all of the shelves in their nesting position are shown in a downwardly extending position, in some situations (for example, where the lower shelf is mounted too close to the floor to allow the shelf to hang downwardly in its nested position) the lower shelf may be pivoted upwardly with respect to the respective bracket pair 26 in which case the lower end of the next shelf above would overlie and hold the lower shelf in its upwardly extending, nested position.

The invention display rack/stock cart will be seen to provide many important advantages as compared to the prior art display racks/stock carts. Specifically, the disclosed notch and pin construction allows each shelf to be selectively but positively moveable between various display positions and further allows each shelf to be readily moved to a nesting position to facilitate nesting of the overall display rack/stock cart.

Whereas a preferred embodiment of the invention has been illustrated and described in detail, it will be apparent that various changes may be made in the disclosed embodiment without departing from the scope or spirit of the invention. For example, although the shelf 16 has been illustrated and described as comprising an open frame structure and a tray having a grate structure, it will be apparent that other shelf constructions are useable with the invention. Specifically, the tray may have a solid construction rather than the open grate structure disclosed.

The invention claimed is:

1. A display rack or stock cart comprising:

a base structure;

an upright member extending rigidly upwardly from the base structure;

at least one shelf member; and coacting interengaging means on the shelf member and on the upright member operative to selectively mount the shelf member on the upright member in a first defined generally horizontal position in which the shelf member is precluded from downward movement, a second defined downwardly inclined position in which the shelf member is precluded from further downward movement, and a third generally vertically downwardly extending nesting position;

the coacting interengaging means comprising coacting notches on one of said members and pins on the other of said members;

the pins comprising a first pin on the other member and a second pin on the other member in laterally and vertically spaced relation to the first pin;

the notches comprising a first notch on the one member and a second notch on the other member;

with a shelf member in its horizontal position, the notches opening upwardly and the first pin being positioned in the first notch;

with the shelf member in its downwardly inclined position, the first pin being positioned in the second notch;

the coacting means further including a slot in said one member;

the second pin being positioned slidably in the slot;

with the shelf member in its vertically downwardly extending position, the second pin being positioned in an upper end of the slot and the first and second notches being disengaged from the pins.

2. A display rack or stock cart according to claim 1 wherein the pins are provided on the upright member and the notches are provided on the shelf member.

3. A display rack or stock cart according to claim 1 wherein the pins are provided on the upright member and the notches and slot are provided on the shelf member.

4. A display rack or stock cart according to claim 3 wherein:

the upright member comprises a post;

the display rack or stock cart further includes a laterally extending bracket fastened to the post; and the pins are secured to the bracket.

5. A display rack or stock cart according to claim 3 wherein:

the upright member comprises a first upright member and the slot comprises a first slot;

the display rack or stock cart further includes a second upright member in spaced relation to the first upright member and including third and fourth pins corresponding in placement and spacing to the first and second pins;

the shelf member is positioned between the first and second upright members;

the shelf member includes a main body portion and spaced first and second attachment portions;

the first and second notches and the first slot are defined on the first attachment portion;

the second attachment portion defines third and fourth notches corresponding in placement and spacing to the first and second notches and a second slot corresponding to the first slot;

with the shelf member in its horizontal position, the first and third pins are positioned in the first and third notches respectively and the second and fourth pins are slidably positioned in the first and second slots respectively; and with the shelf member in its downwardly inclined position, the first and third pins are positioned in the second and fourth notches respectively and the second and fourth pins are slidably positioned in the first and second slots respectively.

6. A display rack or stock cart according to claim 5 wherein, with the shelf member in its vertically downwardly extending position, the second and fourth pins are positioned in an upper end of the first and second slots respectively and the first, second, third, and fourth notches are disengaged from the pins.

7. A display rack or stock cart according to claim 6 wherein the display rack or stock cart includes a plurality of shelf members arranged in vertically spaced relation between the upright members and each including notches and slots for coacting engagement with pins on the upright members, whereby each of the shelf members may be mounted on the upright members in horizontal, downwardly inclined, or vertically downwardly extending positions.

8. A display rack or stock cart according to claim 7 wherein the display rack or stock cart includes casters mounted on the base structure to facilitate movement of the display rack or stock cart around a display surface area.

9. A display rack or stock cart according to claim 7 wherein:

the plurality of vertically spaced shelf members comprise a first set of shelf members;

the first set of shelf members extends generally forwardly from the upright members;

the display rack or stock cart further includes a second set of vertically spaced shelf members extending generally rearwardly from the upright members; and each shelf member of the second set includes notches and slots for coacting engagement with pins on the upright members, whereby each of the shelf members of the second set may be mounted on the upright members in horizontal, downwardly inclined, or vertically downwardly extending positions.

10. A display rack or stock cart comprising a pair of laterally spaced parallel horizontal base rods having free ends, a pair of spaced posts respectively upstanding from midpoints of the respective base rods, and a plurality of shelf members supported on the posts in vertically spaced relation, characterized in that:

the display rack or stock cart includes coacting interengaging means on the posts and on the shelf members operative to selectively mount each shelf member on the post in a first defined generally horizontal position in which the shelf member is precluded from downward movement, a second defined downwardly inclined position in which the shelf member is precluded from further downward movement, and a third generally vertically downwardly extending nesting position;

the rack further includes a plurality of horizontal, vertically spaced cross bars extending between and rigidly interconnecting the spaced posts;

the lowest cross bar is high enough to allow the base rods to move therebeneath to allow nesting of adjacent racks with the shelf members of the racks in downwardly extending nesting positions.

11. A display rack or stock cart according to claim 10 wherein the coacting interengaging means comprises coacting notches on the shelf members and pins on the posts sized to fit selectively in the notches.

12. A display rack or stock cart according to claim 10 wherein:

each shelf member includes a main body support portion and first and second spaced attachment portions;

for each shelf member, the coacting means comprise first and second spaced pins on the first post, third and fourth spaced pins on the second post, first and second spaced notches and a first slot provided on the first attachment portion of the shelf member for coaction with the first and second pins, and third and fourth spaced notches and a second slot provided on the second attachment portion of the shelf member for coaction with the third and fourth pins;

with a shelf member in its horizontal position, the first and third pins are positioned in the first and third notches, respectively, and the second and fourth pins are slidably positioned in the first and second slots, respectively; and with a shelf member in its downwardly inclined position, the first and second pins are positioned in the second and fourth notches, respectively, and the second and fourth pins are slidably positioned in the first and second slots, respectively.

13. A display rack or stock cart according to claim 12 wherein, with a shelf member in its vertically downwardly extending position, the second and fourth pins are positioned in an upper end of the first and second slots respectively and the first, second, third, and fourth notches are disengaged from the pins.

14. A display rack or stock cart according to claim 1 wherein the base structure includes spaced base members defining an opening therebetween to allow the base structure of a second display rack to move into the opening and allow nesting of the display racks or stock carts with the shelf member of each display rack or stock cart in its third, generally vertically downwardly extending position.

* * * * *